United States Patent [19]

Bufford-Thacker

[11] Patent Number: 4,976,004

[45] Date of Patent: Dec. 11, 1990

[54] APPARATUS AND METHOD FOR CLEANING HOT WATER HEATER TANKS

[76] Inventor: Barbara A. Bufford-Thacker, P.O. Box 344, Hartland, Mich. 48029

[21] Appl. No.: 255,592

[22] Filed: Oct. 11, 1988

[51] Int. Cl.[5] ..... A47L 9/02

[52] U.S. Cl. ..... 15/415.1; 15/395; 15/401; 15/414

[58] Field of Search ..... 15/393, 395, 401, 415 R, 15/414, 418, 419, 420, 421

[56] References Cited

U.S. PATENT DOCUMENTS

| | | | |
|---|---|---|---|
| 1,120,980 | 12/1914 | Schofield | 15/415 X |
| 2,198,339 | 4/1940 | Hamilton | 15/395 |
| 2,715,240 | 8/1955 | Pieper et al. | 15/415 |
| 4,053,962 | 10/1977 | McDowell | 15/415 R |
| 4,237,572 | 12/1980 | Larson | 15/236.05 X |
| 4,694,529 | 9/1987 | Choiniere | 15/393 |

FOREIGN PATENT DOCUMENTS

| | | | |
|---|---|---|---|
| 1291117 | 9/1972 | United Kingdom | 15/415 |

*Primary Examiner*—Chris K. Moore

*Attorney, Agent, or Firm*—Joseph W. Farley

[57] ABSTRACT

Apparatus and method for the removal of deposits from the tank bottom of a hot water heater by employing a cleaning tool adapted to be connected to a suction attachment of a vacuum cleaner and inserted into the tank through an opening in the side of the tank adjacent to the tank bottom. The cleaning tool has a configuration such that it can be manipulated to move its intake end over the tank bottom area.

2 Claims, 2 Drawing Sheets

APPARATUS AND METHOD FOR CLEANING HOT WATER HEATER TANKS

SUMMARY OF THE INVENTION

This invention relates to an improved apparatus and method for removing from the tank of a domestic hot water heater the deposits which form in the tank, particularly where the heater is used with hard water.

As hard water deposits gradually build up in the heater tank, the efficiency of the heater is reduced so that in time it becomes desirable and advantageous to clean the tank. However, domestic hot water heaters have not been constructed in such a way as to facilitate their cleaning. Access to the interior of the heater tank is limited. Cleaning with the crude tools available for this purpose (e.g., some form of scraping implement and a spoon) becomes a time consuming process, and an expensive one if done professionally. Consequently, many users of hot water heaters subjected to deposit build-up ignore the problem and its disadvantages.

The present invention offers a solution to the problem of deposit build-up by providing apparatus and a method which enable deposits to be readily removed from the bottom of the tank of a drained hot water heater through an access opening in the side of heater adjacent to the tank bottom.

Briefly, the apparatus of the invention comprises a tubular tool having a cylindrical connector end adapted to be coupled to a vacuum cleaner suction attachment, an opposite intake end and a body extending between the ends. The body has a length greater than the diameter of the heater tank; has a cross-sectional area less than that of the cylindrical connector end; and, is formed with a portion extending coaxially from the connector end and with an offset portion extending curvilinearly from the coaxial portion to the intake end, the offset portion projecting laterally from the coaxial line The configuration of the tool body, including the extent to which the offset portion thereof projects laterally, is related to the shape of the tank bottom an also to the vertical dimension between the access opening and the tank bottom In general, this configuration is such that the tool is positionable through the access opening with the intake end in contact with any desired portion of the tank bottom.

The removal of deposits from a drained hot water heater tank merely requires the operations of providing an access opening in the side of the tank adjacent to the tank bottom by removing from the heater a component such as a heating element or drain valve; coupling the cleaning tool described above to a suction attachment of a vacuum cleaner, preferably of the wet/dry type; inserting the cleaning tool through the access opening and manipulating the tool under suction to move its intake end over the tank bottom. When the cleaning operation has been completed, it is only necessary to close the access opening by replacing the heater component removed therefrom and the heater is ready to be filled and put back in service.

Preferred embodiments of the invention are illustrated in the accompanying drawings and are further described below.

DETAILED DESCRIPTION

Figure 1:
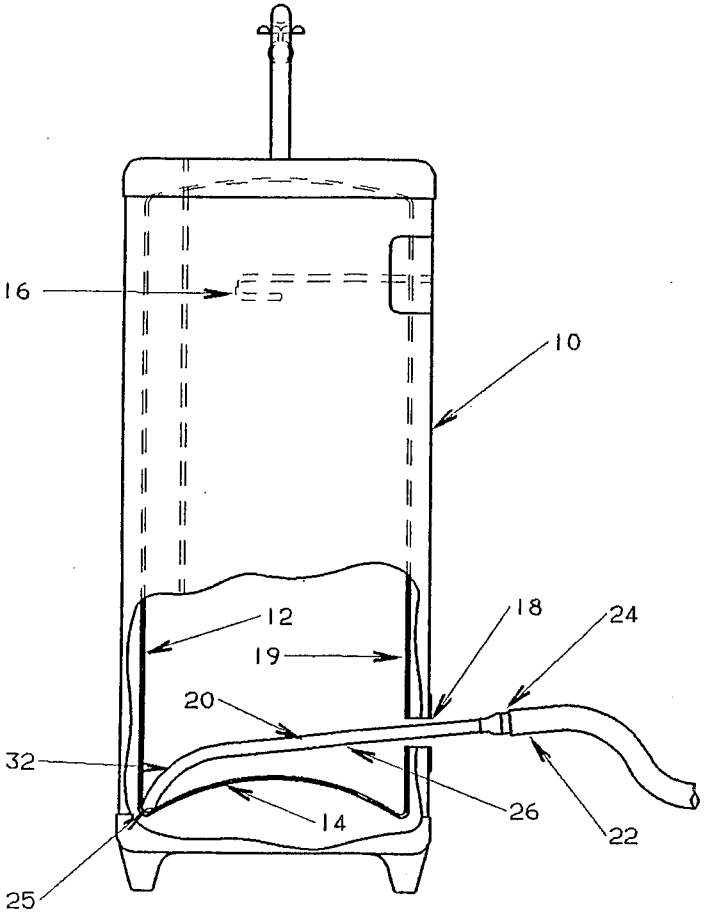
FIG. 1 is an elevation of a conventional electric type hot water heater with the lower portion of the tank broken away to illustrate a cleaning operation utilizing the apparatus of the invention.

A conventional domestic electric-type hot water heater 10 shown in FIG. 1 includes a tank 12 formed with a convex dished bottom 14, and an upper heating element 16. A similar lower heating element has been removed from the heater 10 to provide an access opening 18 in the side 19 of the tank 12 adjacent to the bottom 14. A tubular cleaning tool 20 has been coupled to a suction attachment 22 of a conventional vacuum cleaner (preferably of the wet/dry type) and inserted through the access opening 18.

Figure 3:
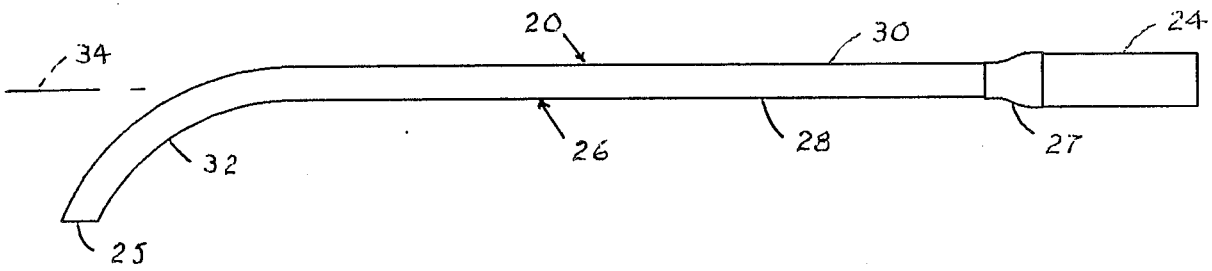
FIG. 3 is an enlarged elevation of the cleaning tool of the invention illustrated in FIG. 1; and, FIG. 4 is an enlarged elevation of the cleaning tool shown in FIG. 2.

As shown in FIG. 3, the tubular tool 20 is provided with a cylindrical connector end 24 adapted to be coupled to the suction attachment 22, an opposite intake end 25 and a body 26. In the construction illustrated, the body 26 includes a reducer 27 extending coaxially from the cylindrical connector end 24 and a tube 28 of lesser diameter extending from the reducer 27 to the intake end 25, the tube having an initial portion 30 coaxial with the reducer and an offset portion 32 extending curvilinearly from the initial portion 30 to the intake end 25.

As can be seen from FIG. 1, the body 26 of the tool 20 has a length greater than the diameter of the tank 12; also, the offset portion 32 projects laterally from a coaxial line 34 a distance which is correlated to the vertical dimension between the access opening 18 and the bottom 14 of the tank. The tool 20 is thus positionable through the access opening with the intake end 25 in contact with any desired portion of the tank bottom 14.

Figure 2:
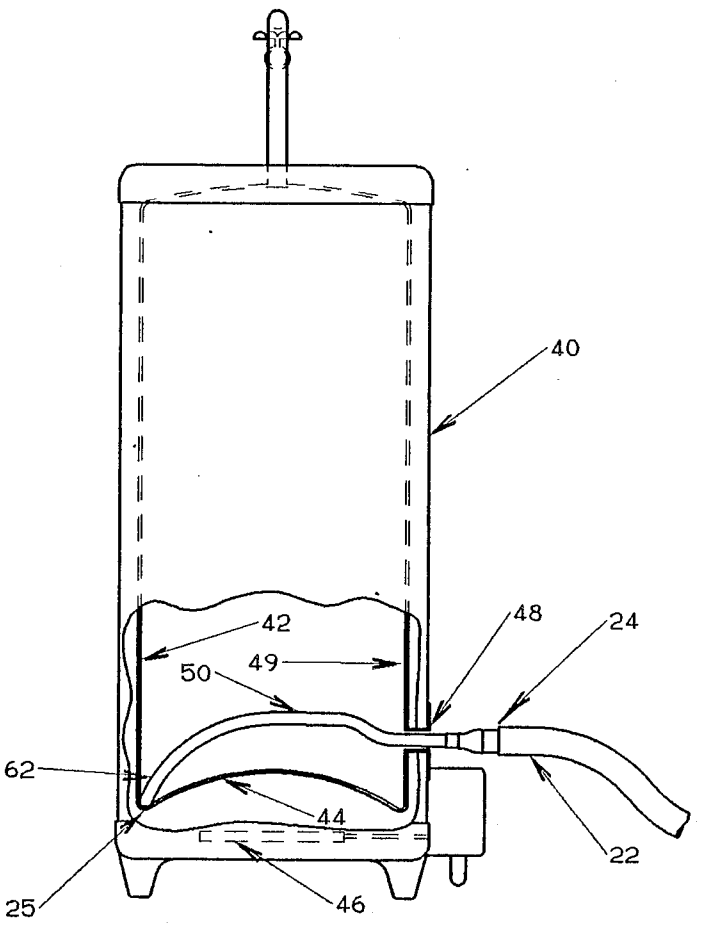
FIG. 2 is an elevation similar to FIG. 1 but showing a conventional gas type hot water heater and a modified form of the apparatus of the invention.

FIG. 2 illustrates a conventional domestic hot water heater 40 of the gas-fired type, having a tank 42 with a convex bottom 44, and a burner 46. An access opening 48 been provided in the side 49 of the tank 42 adjacent to the bottom 44 by removing the drain valve element from the heater 40. A tubular cleaning tool 50 similar to the tool 20 has been coupled to the vacuum cleaner suction attachment 22 and inserted through the access opening 48.

Figure 4:
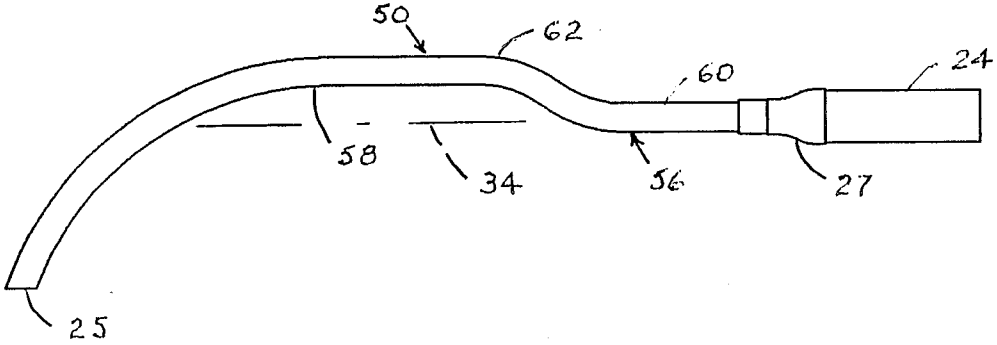

Referring to FIG. 4, the tool 50, like the tool 20, has a connector end 24, an intake end 25 and a body 56 formed by a reducer 27 and a tube 58, the reducer 27 being coaxial with the connector end 24 and the tube 58 being of lesser diameter than the cylindrical connector end 24. The tube has an initial portion 60 which extends coaxially from the reducer 27, and an offset portion 62 which extends from the initial portion 60 to the intake end 25, the offset portion 62 extending to one side of a coaxial line 34 and then extending curvilinearly to the intake end 25 at the other side of the coaxial line 34 FIG. 2 shows that the length of the tool body 56 is greater than the diameter of the tank 42; and that the configuration of the offset portion 62 is related to the convex shape of the tank bottom 44 and to the vertical distance from the access opening 48 to the tank bottom 44. As a result, the tool 50 can be manipulated through the access opening 48 so as to position the intake end 25 in contact with any desired portion of the tank bottom 44.

It is apparent from the foregoing description that the invention results in a relatively simple process or method of removing deposits from the tank of a drained hot water heater, namely, providing the access opening 18 or 48 by removing from the heater a heating element or drain valve component; coupling the cleaning tool 20 or 50 to the suction attachment 22 of a vacuum cleaner; inserting the cleaning tool 20 or 50 through the access opening and manipulating the tool under suction to move the intake end 25 over the tank bottom 14 or 44; and replacing the removed heater component after the deposits have been sucked out and the tool has been withdrawn.

I claim:

1. Apparatus for the suction removal of deposits from the bottom of the tank of a drained hot water heater through an access opening in the side of the heater above the bottom of the tank, comprising:

a tubular tool provided with a cylindrical connector end adapted to be coupled to a vacuum cleaner suction attachment, a body, and an intake end on said body opposite to said connector end, said body having a length greater than the diameter of said tank;

said body comprising a reducer extending from said connector end and a tube of lesser diameter extending from said reducer to said intake end, said tube including a portion coaxial with and adjacent to said connector end and an offset portion extending curvilinearly from said coaxial portion to said intake end, said offset portion projecting laterally from the coaxial line a distance correlated to the vertical dimension between said access opening and the bottom of the tank whereby said tool is positionable through said access opening with said intake end in contact with any desired portion of the bottom of said tank.

2. Apparatus according to claim 1 wherein said tube has an initial portion which extends coaxially from said reducer, and said offset portion extends from said initial portion to one side of said coaxial line and then extends curvilinearly to said intake end at the other side of said coaxial line.

* * * * *